US006378301B2

(12) United States Patent
Endo et al.

(10) Patent No.: US 6,378,301 B2
(45) Date of Patent: Apr. 30, 2002

(54) PRESSURIZED FLUID RECOVERY/ REUTILIZATION SYSTEM

(75) Inventors: Hiroshi Endo; Nobumi Yoshida; Kazuhiro Muruta, all of Tochigi (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/880,552

(22) Filed: Jun. 13, 2001

Related U.S. Application Data

(63) Continuation-in-part of application No. 09/230,671, filed as application No. PCT/JP97/03416 on Sep. 25, 1997.

(30) Foreign Application Priority Data

Sep. 25, 1996 (JP) ..... 8-252999

(51) Int. Cl.[7] ..... F15B 11/00
(52) U.S. Cl. ..... 60/414; 60/417; 60/419
(58) Field of Search ..... 60/414, 417, 419

(56) References Cited

U.S. PATENT DOCUMENTS

| | | | | |
|---|---|---|---|---|
| 5,293,745 A | | 3/1994 | Roche | 60/419 |
| 5,794,441 A | * | 8/1998 | Lisniansky | 60/414 |

FOREIGN PATENT DOCUMENTS

| | | |
|---|---|---|
| JP | 42-25373 | 12/1942 |
| JP | 59-14530 | 4/1984 |
| JP | 59-177802 | 11/1984 |
| JP | 60-195236 | 10/1985 |
| JP | 63-106404 | 5/1988 |
| JP | 3-33922 | 5/1991 |
| JP | 4-219502 | 8/1992 |
| JP | 6-27521 | 4/1994 |
| JP | 10-515499 | 10/1999 |
| WO | WO98/13603 | 4/1998 |

* cited by examiner

*Primary Examiner*—F. Daniel Lopez
*Assistant Examiner*—Thomas E. Lazo
(74) *Attorney, Agent, or Firm*—Frishauf, Holtz, Goodman, Langer & Chick, P.C.

(57) ABSTRACT

Energy of returning pressurized fluid of an actuator is recovered and reused as energy for operating other accumulators. A first pump motor (16) and a second pump motor (17) are mechanically connected to form a pressure converter (18), and a first circuit (22), to which the returning pressurized fluid is supplied, is connected to the first pump motor (16). A pressure accumulator (27) is provided to a second circuit (25) connected to the second pump motor (17). The first circuit (22) is connected to a discharge passage (11) of a primary hydraulic pump (10) by a third circuit (29) and the pressure of a high pressure pressurized fluid is supplied to the discharge passage (11) by the pressure of the high pressure pressurized fluid, and is reused.

5 Claims, 4 Drawing Sheets

PRESSURIZED FLUID RECOVERY/ REUTILIZATION SYSTEM

CROSS-REFERENCE TO RELATED APPLICATIONS

The present application is a Continuation-In-Part (CIP) of U.S. patent application Ser. No. 09/230,671 filed Jan. 29, 1999, which is the U.S. national stage of PCT/JP97/03416 filed Sep. 25, 1997, the entire disclosures of which are incorporated herein by reference.

TECHNICAL FIELD

The present invention relates to a hydraulic oil recovery/reutilization system which accumulates a high pressure fluid by an energy of a pressurized fluid returned from a hydraulic actuator in a construction machine, such as a power shovel or the like and re-uses an accumulated high pressure fluid as an actuation energy of an actuator.

BACKGROUND ART

As a power shovel, there has been known one, in which an upper pivotal body is provided on a lower vehicular body having a traveling body, for pivotal motion by a pivoting hydraulic motor, a boom is mounted on the upper pivotal body for vertical rocking motion by means of a boom cylinder, an arm is mounted on the boom for vertical rocking motion by means of an arm cylinder, and a bucket is mounted on the arm for vertical swing motion by means of a bucket cylinder.

The foregoing pivoting hydraulic motor, the boom cylinder, the arm cylinder and the bucket cylinder are actuated by supplying a discharged pressurized fluid of a hydraulic pump to one chamber and draining the pressurized fluid of another chamber to a tank, by switching direction switching valves.

For example, the discharged pressurized fluid of the hydraulic pump is supplied to an expansion chamber of the boom cylinder by the direction switching valve for the boom, and in conjunction therewith, the pressurized fluid in a compression chamber is drained for actuating the boom cylinder for expansion, and the discharged pressurized fluid of the hydraulic pump is supplied to the compression chamber of the boom cylinder, and in conjunction therewith, the pressurized fluid in the expansion chamber is drained for actuating the boom cylinder for compression.

As set forth above, since the pressurized fluid returned from the pivoting hydraulic motor, the boom cylinder, the arm cylinder and the bucket cylinder is drained to the tank, an energy of the returning pressurized fluid cannot be used.

For example, in the case of a compression operation of the boom cylinder, a pressure is generated in the pressurized fluid returned from the expansion chamber due to the weight of the boom, the arm and the bucket. However, since the returning pressurized fluid is drained to the tank, the pressure (energy) of the returning pressurized fluid cannot be re-used. On the other hand, there has been proposed an apparatus for recovering and re-using the energy of the returning pressurized fluid of the hydraulic actuator. For example, there has been known a pressurized fluid recovering/reutilization system disclosed in Japanese Examined Patent Publication No. Heisei 3-33922.

As shown in FIG. 1, the pressurized fluid recovering/reutilization system is constructed by connecting a chamber 2 of a single action cylinder 1 as an actuator to a port 4 of a first pump motor 3, connecting a port 6 of a second pump motor 5 mechanically coupled with the first pump motor 3 to a pressurized fluid supply circuit 7, connecting the pressurized fluid supply circuit 7 to the hydraulic pressure source via a check valve 8 and to a pressure accumulator 9. With this system, by supplying a pressurized fluid of the hydraulic pressure source to the pressurized fluid supply circuit 7, the second pump motor 5 performs motoring operation to drive the first pump motor 3. Then, the first pump motor 3 performing pumping operation to supply the pressurized fluid to the chamber 2 of the single action cylinder 1 to actuate the single action cylinder 1 for expansion.

When supply of the pressurized fluid to the pressurized fluid supply circuit 7 is terminated, the single action cylinder 1 is actuated for compression by an external load to generate a pressure in the returning pressurized fluid of the chamber 2 to drive the first pump motor 3 for motoring operation.

By this, the second pump motor 5 performs a pumping operation to generate a high pressure fluid to the pressurized fluid supply circuit 7. The flow of the high pressure fluid is blocked by the check valve 8 and the pressure is accumulated in the pressure accumulator 9.

Then, when the single action cylinder 1 is operated again for expansion by supplying the pressurized fluid to the pressurized fluid supply circuit 7, the high pressure fluid accumulated in the pressure accumulator 9 drives the second pump motor 5. Thus, the first pump motor 3 performs pumping operation to supply high pressure fluid to the chamber 2 to enable re-using of the pressurized fluid (energy) accumulated in the pressure accumulator 9.

The foregoing system accumulates high pressure fluid by energy of the returning pressurized fluid of the chamber 2 of the single action cylinder 1 to supply the pressurized fluid to the chamber 2 of the single action cylinder 1 by the accumulated high pressure fluid again. Thus, the accumulated high pressure fluid is re-used only for the single action cylinder and cannot be re-used for other actuators.

Therefore, an object of the present invention is to provide a pressurized fluid recovering and reutilization system which can solve the problem set forth above.

DISCLOSURE OF THE INVENTION

The first invention is a pressurized fluid recovery/reutilization system characterized by supplying a pressurized fluid of high pressure to a hydraulic pressure source by operating a pressure converter 18 constructed with a first pump motor 16 and a second pump motor 17 which are mechanically coupled by an energy of a pressurized fluid returned from an actuator actuated by the pressurized fluid of the hydraulic power source.

By the first invention, since the pressurized fluid of high pressure is supplied to the hydraulic pressure source by the energy of the returning pressurized fluid of the actuator, the recovered returning pressurized fluid of the actuator can be reused for actuation of another actuator.

The second invention is a pressurized fluid recovery/reutilization system which comprises a primary hydraulic pump 10 supplying a pressurized fluid returned from an actuator, a first circuit 22 supplied the returning pressurized fluid from the actuator, a first pump motor 16 connected to said first circuit 22, a variable displacement type second pump motor 17 mechanically coupled with said first pump motor 16 and connected to a second circuit 25, a third circuit 29 communicating said first circuit 22 and a discharge passage 11 of said primary hydraulic pump 10, a pressure accumulator 27 provided in said second circuit 25, and a reproduction valve 30 switching said third circuit between a state permitting the flow of a pressurized fluid and a state blocking the flow.

By second invention, by switching the flow of the pressurized fluid in the third circuit is switched into blocking state by the reproduction valve 30, the first pump motor 16 is operated for motoring operation by the returning pressurized fluid to cause pumping operation of the second pump motor 17. Thus, the pressurized fluid of high pressure can be accumulated in the pressure accumulator 27.

By switching the third circuit 29 to permit the flow of the pressurized fluid by the reproduction valve 30, the second pump motor 17 is operated to perform motoring operation by the accumulated pressurized fluid of high pressure to cause pumping operation of the first pump motor 16 to supply the discharge passage 11 of the primary hydraulic pump 10 via the third circuit 29 by discharging fluid to the first circuit 22.

By this, the energy of the returning pressurized fluid of the actuator can be reused for actuation of another actuator.

On the other hand, when the second pump motor 17 performs motoring operation, an output torque of the second pump motor 17, namely a torque for driving the first pump motor 16, is varied by increasing and decreasing of the displacement of the second pump motor 17. Thus, by pumping operation of the first pump motor 16, the pressure in the first circuit 22 can be increased and decreased.

By this, the pressure of the first circuit 22 is set to be equal to the pressure of the discharge passage 11 of the primary hydraulic pump 10 or slightly higher than the latter, the pressure in the first circuit 22 can be supplied to the discharge passage 11 of the primary hydraulic pump 10 and reused.

The third invention is a pressurized fluid recovery/reutilization system in which a pressure accumulation valve 26 is provided for establishing and blocking communication of said second circuit 25, and a sequence valve 28 is provided between said second circuit 25 on the side of said second pump motor 17 of said pressure accumulation valve 26 and the discharge passage 11 of the primary hydraulic pump 10.

By the third invention, if the second circuit 25 is blocked by the pressure accumulation valve 26 in the condition where accumulation of the pressurized fluid of high pressure in the pressure accumulator is completed, leakage of the pressurized fluid of high pressure accumulated in the pressure accumulator 27 can be prevented.

On the other hand, when the pressurized fluid of high pressure is fully accumulated in the pressure accumulator 27, since the pressurized fluid of high pressure of the second circuit 25 is supplied from the sequence valve 28 to the primary hydraulic pump 10, the displacement of the pressure accumulator 27 can be made small.

On the other hand, by closing the pressure accumulation valve 26 while the pressure is accumulated by pumping operation of the second pump motor 17, the pressurized fluid of high pressure discharged from the second pump motor 17 is directly supplied to the discharge passage 11 of the primary hydraulic pump 10 from the sequence valve 28.

By this, the energy of the recovered returning pressurized fluid can be reused immediately.

The fourth invention is a pressurized fluid recovery/reutilization system which comprises a primary hydraulic pump 10 supplying a pressurized fluid returned from an actuator, a first circuit 22 supplied the returning pressurized fluid from the actuator, a recovery valve 23 for switching said first circuit 22 between a first state permitting the flow of the pressurized fluid and a second state blocking the flow, a pressure converter 18 having a first pump motor 16 connected to said first circuit 22, a variable displacement type second pump motor 17 mechanically coupled with said first pump motor 16 and connected to a second circuit 25, a third circuit 29 communicating said first circuit 22 and a discharge passage 11 of said primary hydraulic pump 10, a pressure accumulator 27 provided in said second circuit 25, a reproduction valve 30 switching said third circuit between a state permitting the flow of a pressurized fluid and a state blocking the flow, a pressure accumulation valve 26 provided for establishing and blocking communication of said second circuit 25, and a sequence valve 28 provided between said second circuit 25 on the side of said second pump motor 17 of said pressure accumulation valve 26 and the discharge passage 11 of the primary hydraulic pump 10.

According to the fourth invention, after accumulation of the pressurized fluid of high pressure in the pressure accumulator 27, the recovery valve 23 is placed in the second condition (closed), the pressure accumulation valve 26 is in communicating state and the reproduction valve 30 is in the first state (open), and in conjunction therewith, the set pressure of the sequence valve 28 is set by high pressure, the accumulated pressured fluid of high pressure can be supplied to the discharge passage 11 of the primary hydraulic pump 10 from the third circuit 29 via the pressure converter 18.

On the other hand, by placing the recovery valve 23 and the reproduction valve 30 at the second condition (closed) and the pressure accumulation valve 26 in communicating condition, and in conjunction therewith, by setting the sequence valve 28 at low pressure, the accumulated pressurized fluid of high pressure can be supplied to the discharge passage 11 of the primary hydraulic pump 10 via the sequence valve 28.

Thus, by driving the pressure converter 18 with the pressurized fluid of high pressure accumulated in the pressure accumulator 27, the pressured fluid of low pressure and large flow rate can be supplied to the discharge passage 11.

As set forth above, the pressurized fluid of pressure and high flow rate can be supplied to the discharge passage 11 by the pressurized fluid of high pressure accumulated in the pressure accumulator 27, and whereby driving the pressure converter 18. Also, the pressurized fluid of high pressure accumulated in the pressure accumulator can be supplied to the discharge passage 11 via the sequence valve 28.

While the actuator is in actuated state, by placing the recovery valve at the first condition (open), the pressure accumulation valve 26 at the closed position, the reproduction valve 30 at the second position (closed), and further setting the set pressure of the sequence valve 28 at low pressure, the returning pressurized fluid of the first circuit 22 can be supplied via the pressure converter 18 and the sequence valve 28.

On the other hand, by placing the recovery valve 23 and the reproduction valve 30 at the first position (open) and the pressure accumulation valve 26 at a closed position, and further setting the set pressure of the sequence valve 28 at high pressure, the returning pressurized fluid of the first circuit 22 can be supplied to the discharge passage 11 through the third circuit.

As set forth above, the returning pressurized fluid from the actuator can be supplied to the discharge passage with elevating the pressure converter 18 without accumulating the pressure of the pressurized fluid, and also, the returning pressurized fluid can be efficiently supplied to the discharge passage 11 via the third circuit 29 without accumulating the pressure of the pressurized fluid.

The fifth invention is a pressurized fluid recovery/reutilization system as set forth in claim 4, which includes first means for detecting a discharge pressure P2 of said primary hydraulic pump 10, a second means for detecting an accumulated pressure P1 of said pressure accumulator 27 of said second circuit 25, and third means for switching said recovery valve 23, said pressure accumulation valve 26 and said reproduction valve 30 on the basis of detected pressures of said first and second means, and in conjunction therewith to vary the set pressure of said sequence valve 28, said third means has a function for placing said recovery valve 23 at said second state, said pressure accumulation valve 26 in a communicating condition and said reproduction valve 30 in the first condition and in conjunction therewith setting the set pressure of said sequence valve 28 at high pressure when a differential pressure of said accumulated pressure P1 and the discharge pressure P2 is higher than or equal to a set differential pressure, and placing said recovery valve 23 and said reproduction valve 30 at said second state and said pressure accumulation valve 26 at the communicating condition and in conjunction therewith setting the set pressure of said sequence valve 28 at low pressure when the differential pressure of said accumulated pressure P1 and the discharge pressure P2 is lower than or equal to said set differential pressure.

By the fifth invention, when the differential pressure of the accumulated pressure P1 and the discharge pressure P2 is higher than or equal to the set pressure, the recovery valve 23 is placed at the second position (closed), the pressure accumulation valve 26 is placed at communicating position, the reproduction valve 30 is placed at the first position (open), and the set pressure of the sequence valve 28 is set at high pressure. Thus, the accumulated pressurized fluid of high pressure is supplied to the discharge passage 11 of the primary hydraulic pump 10 from the third circuit 29 via the pressure converter 18.

On the other hand, when the differential pressure between the accumulated pressure P1 and the discharge pressure P2 is less than or equal to the set differential pressure, the recovery valve 23 and the reproduction valve 30 are placed at the second position (closed), the pressure accumulation valve 26 is placed in a communicating position, and the set pressure of the sequence valve 28 is set at low pressure. Thus, the accumulated pressurized fluid of high pressure is efficiently supplied to the discharge passage 11 of the primary hydraulic pump 10 via the sequence valve 28.

As set forth above, since the accumulated pressurized fluid of high pressure can be supplied selectively via the pressure converter 18 or via the sequence valve 28 depending upon the differential pressure between the accumulated pressure P1 and the discharge pressure P2, the accumulated pressurized fluid of high pressure can be efficiently supplied to discharge passage 11 for effective use.

The sixth invention is a pressurized fluid recovery/reutilization system including first means for detecting a discharge pressure P2 of said primary hydraulic pump 10, a third means for detecting the pressure P3 of a returning pressurized fluid of said first circuit 22, and third means for switching said recovery valve 23, said pressure accumulation valve 26 and said reproduction valve 30 on the basis of detected pressures of said first and third means, and in conjunction therewith to vary the set pressure of said sequence valve 28, said third means has a function for placing said recovery valve 23 at said first state, said pressure accumulation valve 26 in a blocking condition and said reproduction valve 30 in the second condition and in conjunction therewith setting the set pressure of said sequence valve 28 at low pressure when said pressure P3 is lower than said discharge pressure P2, and placing said recovery valve 23 and said reproduction valve 30 at said first state and said pressure accumulation valve 26 at the blocking condition and in conjunction therewith setting the set pressure of said sequence valve 28 at high pressure when said pressure P3 is higher than said discharge pressure P2.

By the sixth invention, when the pressure P3 of the returning pressurized fluid is lower than the discharge pressure P2, the recovery valve 23 is placed at the first position (open), the pressure accumulation valve 26 is placed at blocking position, the reproduction valve 30 is replaced at the second position (closed) and the set pressure of the sequence valve 28 is set at low pressure. Thus, the returning pressurized fluid of the first circuit 22 is supplied to the discharge passage 11 via the pressure converter 18 and the sequence valve 28.

On the other hand, when the pressure P3 of the returning pressurized fluid is higher than the discharge pressure P2, the recovery valve 23 and the reproduction valve 30 are placed at the first position (open), the pressure accumulation valve 26 is placed at blocking position, and the set pressure of the sequence valve 28 is set at high pressure. Thus, the returning pressurized fluid of the first valve 22 is supplied to the discharge passage 11 through the third circuit 29.

As set forth above, when the pressure of the returning pressurized fluid is lower than the discharge pressure, the returning pressurized fluid from the actuator can be supplied to the discharge passage with elevating the pressure by the pressure converter 18 with accumulation of the returning pressurized fluid, and when the pressure of the returning pressurized fluid is higher than the discharge pressure, the returning pressurized fluid can be efficiently supplied to the discharge passage 11 via the third circuit 29 without accumulation of the returning pressurized fluid.

BRIEF DESCRIPTION OF THE DRAWINGS

The present invention will be understood more fully from the detailed description given herebelow and from the accompanying drawings of the preferred embodiment of the present invention, which, however, should not be taken to be limitative to the invention, but are for explanation and understanding only.

In the drawings.

BEST MODE FOR IMPLEMENTING THE INVENTION

Figure 1:
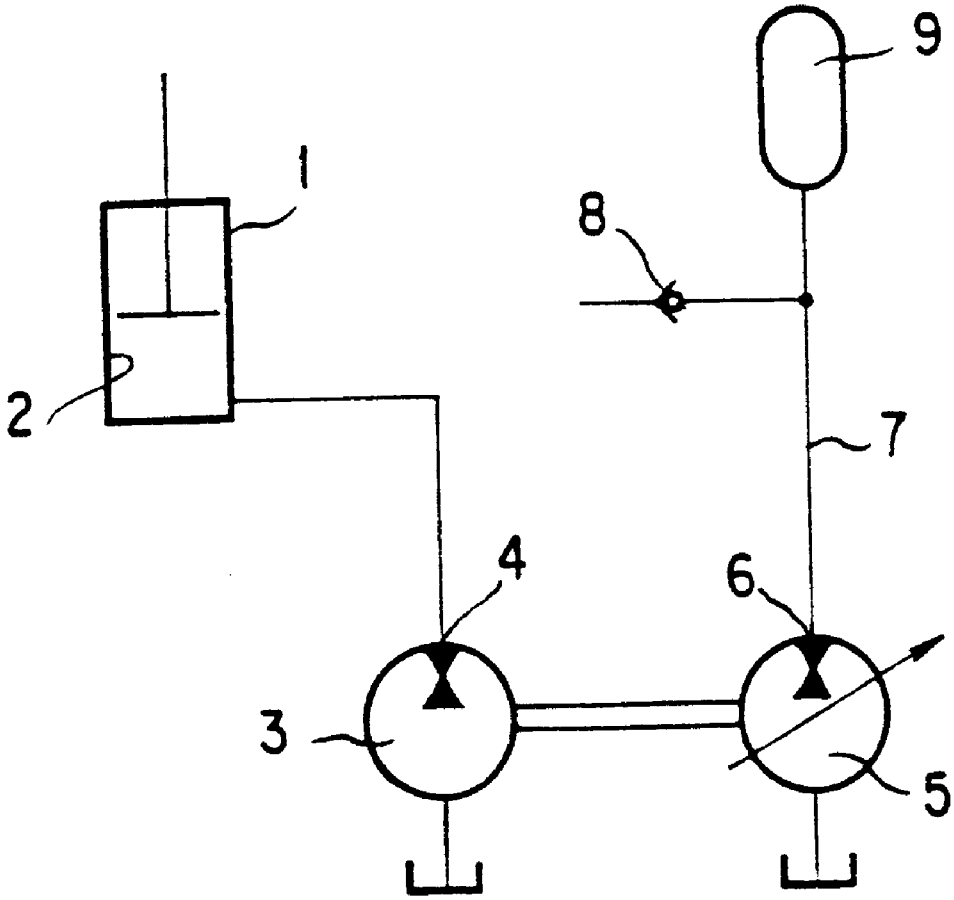
FIG. 1 is a diagram of the conventional hydraulic circuit.
Figure 2:
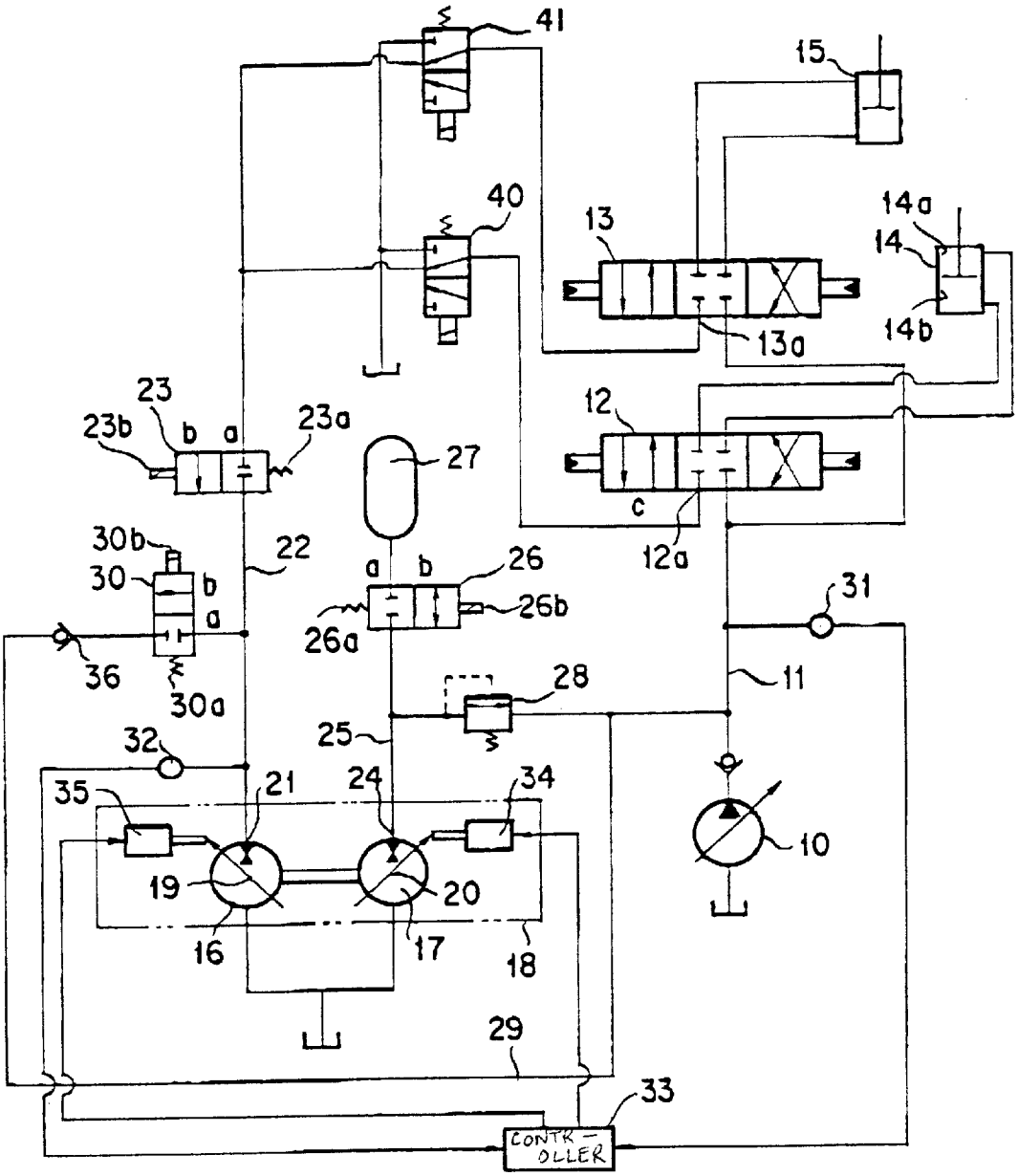
FIG. 2 is a hydraulic circuit diagram showing the first embodiment of the present invention.

As shown in FIG. 2, in a discharge passage 11 of a primary hydraulic pump 10, a first direction switching valve 12 and a second direction switching valve 13 are provided for supplying a pressurized fluid to a first actuator 14 and a second actuator 15.

A first pump motor 16 and a second pump motor 17 are mechanically coupled to form a pressure converter 18. The first pump motor 16 is a variable displacement type variable of displacement by varying a tilting angle of a swash plate 19. The second pump motor 17 is a variable displacement type variable of displacement by varying a tilting angle of a swash plate 20.

A primary port 21 of the first pump motor 16 is connected to a first circuit 22. The first circuit 22 is connected to a return port 12*a* of the first direction switching valve 12 and a return port 13*a* of the second direction switching valve 13 via a recovery valve 23 to supply returning pressurized fluid of the first actuator 14 and the second actuator 15.

A primary port 24 of the second pump motor 17 is connected to a second circuit 25.

The second circuit 25 is connected to a pressure accumulator 27 via a pressure accumulation valve 26, and is also connected to a discharge passage 11 of the primary hydraulic pump 10 via a sequence valve 28.

The first circuit 22 is connected to the discharge passage 11 of the primary hydraulic pump 10 through a third circuit 29. A reproduction valve 30 is provided in the third circuit 29. The reproduction valve 30, the recovery valve 23 and the pressure accumulation valve 26 are held at a closed position a by springs 30*a*, 23*a* and 26*a* and placed at open position b by supplying power to solenoids 30*b*, 23*b* and 26*b*.

In the discharge passage 11 of the primary hydraulic pump 10, a first pressure sensor 31 is provided. A second pressure sensor 32 is provided in the first circuit 22. Detected pressure of the first pressure sensor 31 and the second pressure sensor 32 are input to a controller 33. The controller 33 is responsive to the input of a re-use signal to control displacement of the second pump motor 17 so as to make the detected pressure of the first pressure sensor 31 and the detected pressure of the second pressure sensor 32 equal by inputting a displacement control signal to a displacement control member 34 of the second pump motor 17.

Next, operation for accumulating pressure by recovering the returning pressurized fluid will be discussed.

When a power is supplied to the solenoid 23*b* of the recovery valve 23 to place the recovery valve in an open position b and, in conjunction therewith, a power is supplied to the solenoid of the pressure accumulation valve 26 to place the pressure accumulation valve in the open position b, and, at this condition, the first direction switching valve 12 is placed to a first position c to supply the pressurized fluid to one of chamber 14*a* of the first actuator 14 for compressing operation, the returning pressurized fluid in another chamber 14*b* flows into the first circuit 22 through the return port 12*a*. At this time, the reproduction valve 30 is held in a closed position a.

A first solenoid valve 40 is provided between the recovery valve 23 and the return port 12*a* of the first direction switching valve 12. A second solenoid valve 41 is provided between the recovery valve 23 and the return port 13*a* of the second direction control valve. The first solenoid valve 40 is placed at a first position to supply the returning pressurized fluid of the first actuator 14 to the recovery valve 23 or a second position to drain the returning pressurized fluid to the tank. The second solenoid valve 41 is placed at a first position to supply the returning pressurized fluid of the second actuator 15 to the recovery valve 23 or a second position to drain the returning pressurized fluid to the tank. When the recovery valve 23 is closed, the first and second solenoid valves 40 and 41 are placed at the second positions to drain the returning pressurized fluids of the first and second actuators 14 and 15 to the tank, respectively.

The pressurized fluid flowing into the first circuit 22 flows into the primary port 21 of the first pump motor 16 to cause motoring operation of the first pump motor 16 to drive the second pump motor 17. At this time, by making the displacement of the second pump motor 17 small, the high pressure fluid is ejected as driven at the same driving torque.

This operation may also be performed by outputting a small displacement signal to the displacement control member 34 by the controller by inputting a recovery signal to the controller 33.

It should be noted that power may be supplied to the solenoid 23*b* of the recovery valve 23 and the solenoid 26*b* of the pressure accumulation valve 26 by the controller 33.

By this, the second pump motor 17 performs pumping operation to discharge high pressure fluid to the second circuit 25 to accumulate high pressure fluid in the pressure accumulator 27. At this time, when high pressure fluid of the pressure accumulator 27 becomes full, the pressure of the second circuit 25 becomes higher than a set pressure of the sequence valve 28. Then, the high pressure fluid of the second circuit 25 is supplied to the discharge passage 11 of the primary hydraulic pump 10.

In this operation, since the reproduction valve 30 is held in a closed position a, the returning pressurized fluid flowing into the first circuit 22 will not flow into the discharge passage 11 even when the pressure is higher than the pressure of the discharge passage 11. Also, even though the pressure of the discharge passage 11 is higher than the returning pressurized fluid flowing into the first circuit 22, the pressurized fluid in the discharge passage 11 will never flow into the first circuit 22.

After completion of recovering operation, the pressure accumulation valve 26 is placed in the closed position a to maintain the high pressure fluid for preventing the high pressure fluid accumulated in the pressure accumulator 27 from flowing out.

Next, the first operation for re-using the accumulated high pressure fluid will be discussed. Terminating power supply to the solenoid 23*b* of the recovery valve 23 to place the recovery valve at the closed position a, in conjunction therewith, power is supplied to the solenoids 26*b* and 30*b* of the pressure accumulation valve 26 and the reproduction valve 30 to place them at the closed position b.

By this, the high pressure fluid accumulated in the pressure accumulator 27 flows into the primary port 24 of the second pump motor 17 from the second circuit 25 to cause motoring operation of the second pump motor 17 to drive the first pump motor 16.

The first pump motor 16 performs pumping operation to discharge the high pressure fluid to the first circuit 22 to supply the high pressure fluid from the third circuit 29 to the discharge passage 11 of the primary hydraulic pump 10. At this time, the displacement of the second pump motor 17 is controlled so that the pressure of the discharge passage 11 and the pressure of the first circuit 22 become equal (or the pressure of the first circuit 22 becomes slightly higher). Particularly, when the pressure of the first circuit 22 is lower than the pressure of the discharge passage 11, a larger displacement signal is output to the displacement control member 34 to make the displacement of the second pump motor 17 larger and thus makes an output torque (drive torque of the first pump motor 16) of the second pump motor 17 for enabling the first pump motor 16 to output the high pressure fluid. When the pressure of the first circuit 22 is higher than the pressure of the discharge passage 11, control opposite to the foregoing is performed.

Since the first pump motor 16 is a variable displacement type, when the pressure of the first circuit 22 is lower than the pressure of the discharge passage 11 even when the displacement of the second pump motor 17 is made larger, smaller displacement signal is input to the displacement control member 35 from the controller 33 to make the displacement of the first pump motor 16 smaller to enable discharging of the high pressure fluid.

Namely, the first pump motor 16 is formed as a variable displacement type in order to make the pressure converting region large. When the pressure converting region is small, the first pump motor 16 may be a fixed displacement type.

It should be noted that in order to certainly prevent the pressurized fluid of the discharge passage from causing surge flow from the third circuit 29 to the first circuit 22, a check valve 36 may be provided in the third circuit 29.

Next, operation for immediately re-using the energy of the recovered returning pressurized fluid without accumulating the same will be discussed. By placing the recovery valve 23 at open position a, and placing the reproduction valve 30 and pressure accumulation valve 26 at a closed position b, the returning pressurized fluid flowing into the first circuit 22 is elevated the pressure by the pressure converter 18 and is discharged to the second circuit 22. When the pressure is elevated to be higher than a set pressure of the sequence valve 28, the pressurized fluid is directly supplied to the discharge passage 11. At this condition, by placing the reproduction valve 30 at the closed position b, the returning pressurized fluid is supplied to the discharge passage 11 from the third circuit 29.

Next, second embodiment of the present invention will be discussed.

Figure 3:
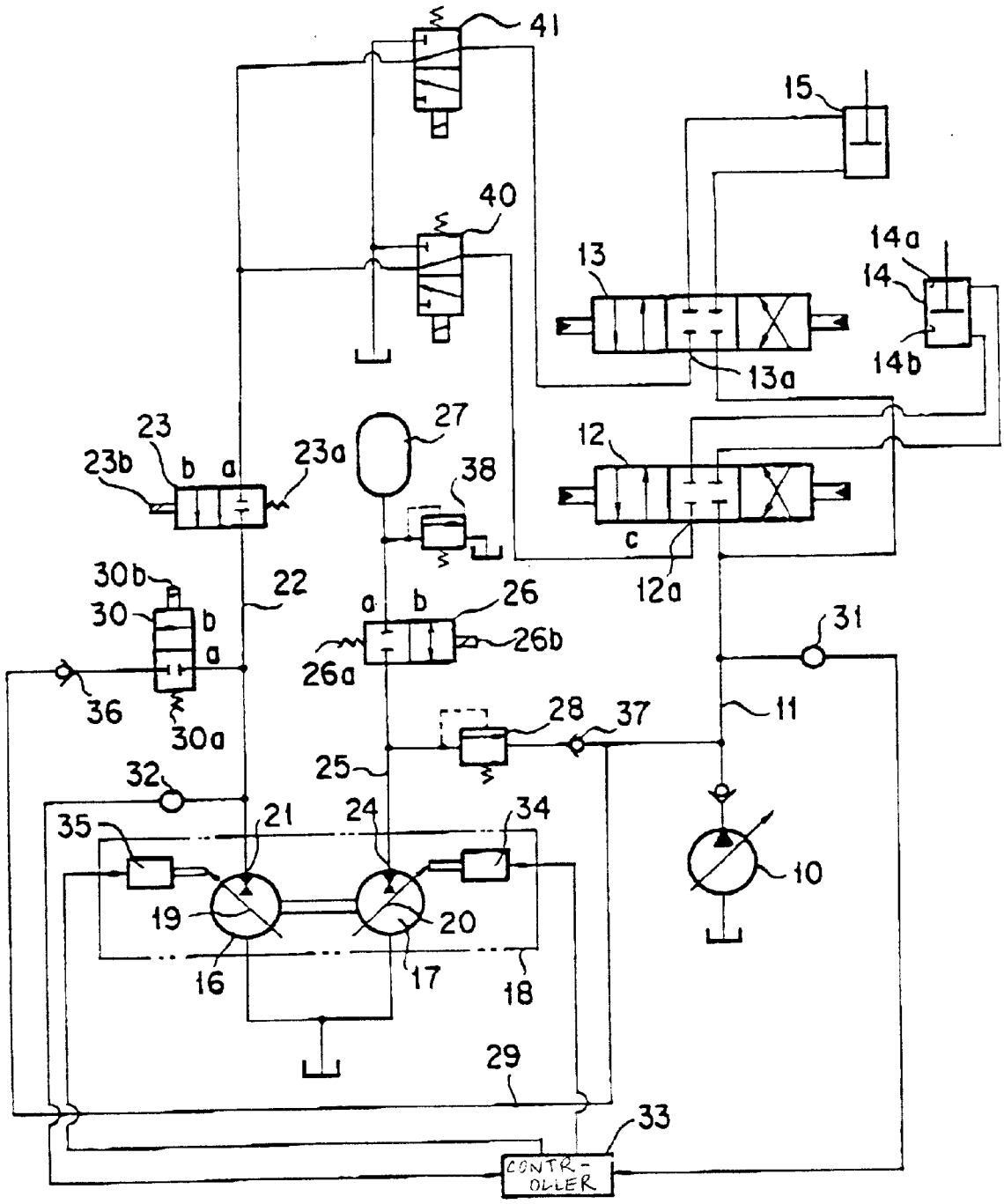
FIG. 3 is a hydraulic circuit diagram showing the second embodiment of the present invention.

As shown in FIG. 3, by providing the second check valve 37 on the output side of the sequence valve 28, surge flow from the discharge passage 11 of the primary hydraulic pump 10 to the second circuit 25 can be certainly prevented. Namely, while the surge flow from the discharge passage 11 to the second circuit 25 can be prevented by the sequence valve 28, a second check valve 37 is provided in order to certainly prevent surge flow even when internal leakage of the pressurized fluid or malfunction is caused in the sequence valve 28.

By providing a safety valve 38 between the pressure accumulation valve 26 and the pressure accumulator 27, the maximum pressure of the internal pressure of the pressure accumulator 27. Namely, at a peak pressure due to abrupt switching of the pressure accumulation valve 26 upon pressure accumulation or elevation of an internal pressure within the pressure accumulator 28 due to elevation of an environmental temperature or so forth, the safety valve 38 performs relief operation to restrict the maximum pressure of the internal pressure so as not to be higher than or equal to a set pressure of the safety valve 38.

Next, the third embodiment of the present invention will be discussed.

Figure 4:
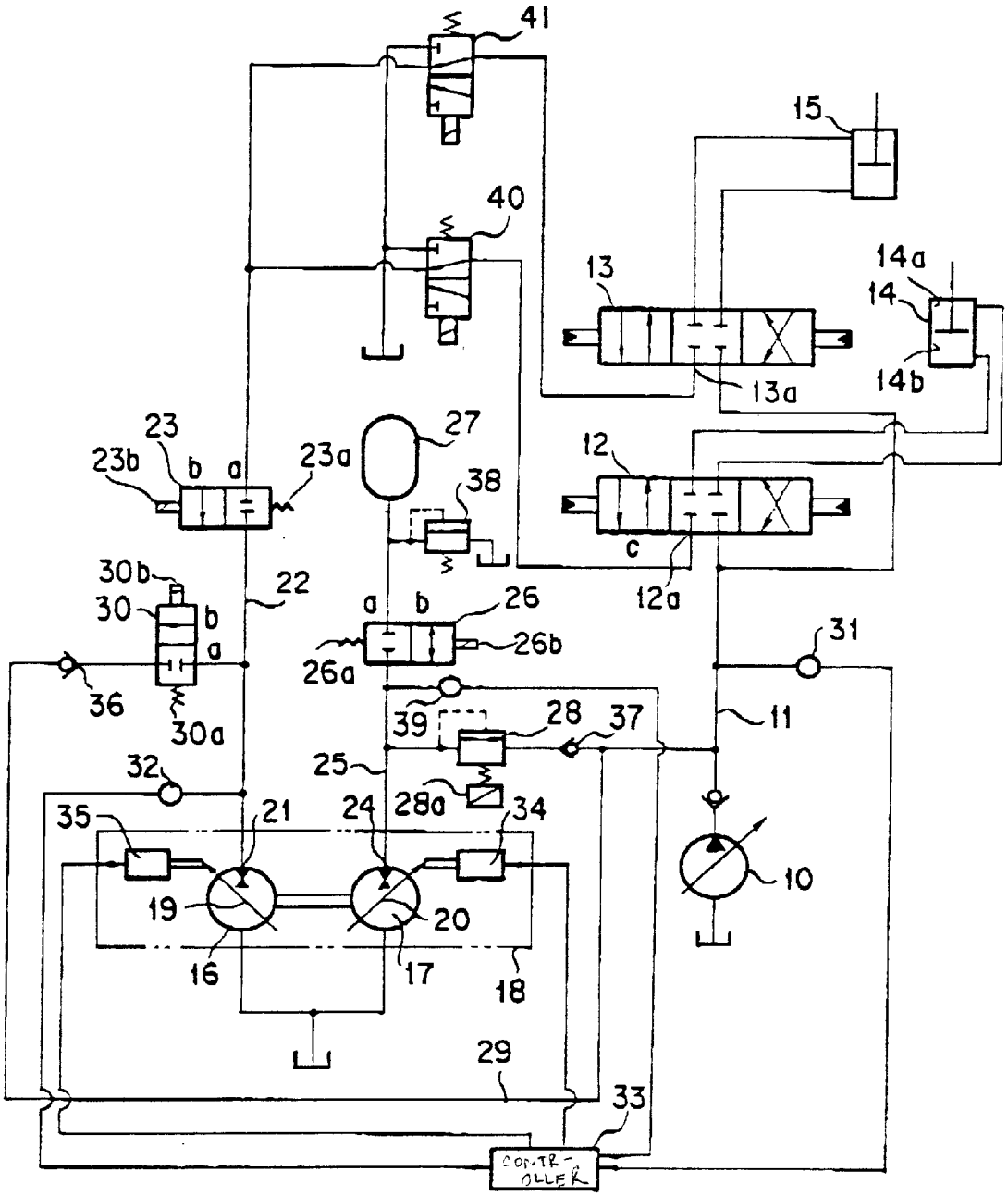
FIG. 4 is a hydraulic circuit diagram showing the third embodiment of the present invention.

As shown in FIG. 4, the sequence valve 28 is constructed as a set pressure variable type. For example, the sequence valve 28 is constructed as an electromagnetically variable set pressure type which develops the set pressure proportional to power supply amount to a solenoid 28*a*. A third pressure sensor 39 for detecting the pressure of the second circuit 25 is provided for inputting a detected pressure to the controller 33.

Next, operation for recovering and accumulating the returning pressurized fluid will be discussed.

In the similar manner to the foregoing first embodiment, the pressure is accumulated in the pressure accumulator 27. At this time, by making power supply amount to the solenoid 28*a* of the sequence valve 28 large, the set pressure is set at high pressure.

By this, the pressurized fluid of high pressure accumulated in the pressure accumulator 27 flows into the primary port 24 of the second pump motor 17 from the second circuit 25 to cause motoring operation of the second pump motor 17 to drive the first pump motor 16. The first pump motor 16 performs pumping operation to discharge the pressurized fluid of high pressure to the first circuit 22. The pressurized fluid of high pressure is thus supplied to the discharge passage 11 of the primary hydraulic pump 10 from the third circuit 29.

Namely, in the similar manner to the first embodiment, the pressurized fluid of high pressure is supplied to the discharge passage 11 of the primary hydraulic pump 10 via the pressure converter 18 and the third circuit 29 for re-using.

Next, second operation re-using the accumulated pressurized fluid of high pressure will be discussed.

By terminating power supply to a solenoid 23*b* of the recovery valve 23 to place at the closed position a and supplying power to a solenoid 26*b* of the pressure accumulation valve 26 at the open position b, the reproduction valve 30 is placed at the closed position a. BY making power supply amount to the solenoid 28*a* of the sequence valve 28 small, the set pressure is set at low pressure.

By this, the pressurized fluid of high pressure accumulated in the pressure accumulator 27 flows into the primary port 24 of the second pump motor 17 from the second circuit 25 to perform motoring operation of the second pump motor 17 to drive the first pump motor 16. However, since the first circuit 22 connected to the primary port 21 of the first pump motor 16 is closed by the recovery valve 23 and the reproduction valve 30, the pressurized fluid discharged from the primary port 21 of the first pump motor 16 is blocked. Also, since the set pressure of the sequence valve 28 is low pressure, the pressurized fluid of high pressure accumulated in the pressure accumulator 27 is supplied to the discharge passage 11 of the primary hydraulic pump 10 by the sequence valve 28.

Next, operation for automatically selecting the foregoing first operation and the second operation will be discussed.

The controller 33 calculates a differential pressure $\Delta P$ of the internal pressure P1 of the pressure accumulator 27 (hereinafter referred to as accumulated pressure) and a discharge pressure P2 of the primary hydraulic pump 10 detected by the first pressure sensor 31 and makes judgment to perform the first operation when the differential pressure $\Delta P$ is greater than or equal to a set differential pressure $\Delta P1$ and to perform second operation when the differential pressure $\Delta P$ is smaller than or equal to the set differential pressure $\Delta P1$.

The foregoing set differential pressure $\Delta P1$ is a pressure substantially equal to a lost horse power due to the pressure converter 18 and a lost horse power due to pressure loss of the sequence valve 28, for example about 20 kg/cm2.

The controller 33 is responsive to the judgement to perform the first operation to switch the recovery valve 23, the pressure accumulation valve 26 and the reproduction valve 30 as set forth above, and in conjunction therewith, to set the set pressure of the sequence valve 28 at high pressure.

As set forth above, when the differential pressure $\Delta P$ between the accumulated pressure P1 and the discharge pressure P2 is higher than or equal to the set differential pressure $\Delta P1$ (when the discharge pressure P2 is low pressure, the first operation is selected to supply the accumulated pressurized fluid of high pressure to the discharge passage 11 of the primary hydraulic pump 10 via the pressure converter 18 and the third circuit 29.

By this, using the accumulated fluid of high pressure, a large amount of the pressurized fluid of low pressure can be supplied to the discharge passage 11. Namely, since the discharge pressure P2 is low, the pressure to be supplied to the discharge passage 11 may be low. Therefore, the angle of the swash plate of the second pump motor 17 of the pressure converter 18 is set small for high speed revolution, and the angle of the swash plate of the first pump motor 16 is set large to make the discharge pressure low and the discharge amount large for supplying large amount of the pressurized fluid of low pressure to the discharge passage 11.

Next, the first operation re-using the recovered energy of the returning pressurized fluid without accumulation will be discussed.

By placing the recovery valve 23 at the closed position b and placing the pressure accumulation valve 26 at the closed position a, the set pressure of the sequence valve 28 is set at low pressure. By this, the returning pressurized fluid flowing into the first circuit 22 is elevated in pressure by the pressure converter 18 as set forth above and discharged to the second circuit 25, and is directly supplied to the discharge passage 11 when the pressure becomes higher than or equal to the set pressure of the sequence valve 28.

Since the returning pressurized fluid can be supplied to the discharge passage 11 with elevating the pressure by the pressure converter 18 as set forth above, the pressure can be directly re-used without accumulation even when the pressure of the returning pressurized fluid is lower than the discharge pressure.

Next, the second operation for re-using the energy of the recovered returning pressurized fluid without accumulation will be discussed.

By placing the recovery valve 23 and the reproduction valve 30 at the open positions b, and placing the pressure accumulation valve 26 at the closed position a, the set pressure of the sequence valve 28 is set at high pressure.

By this, the returning pressurized fluid flowing into the first circuit 22 is discharged to the second circuit 25 in similar manner to the first operation. However, since the set pressure of the sequence valve 28 is high pressure, the returning pressurized fluid flowing into the first circuit 22 is supplied to the discharge passage 11 of the primary hydraulic pump 10 through the reproduction valve 30 and the third circuit 29.

Thus, the returning pressurized fluid can be directly supplied without passing the pressure converter 18. Therefore, the returning pressurized fluid can be re-used efficiently when the pressure of the returning pressurized fluid is higher than the discharge pressure. Next, discussion will be given for automatic selection between the first operation and the second operation directly using the returning pressurized fluid in the manner set forth above.

The controller 33 makes judgment of large and small of the discharge pressure P2 from the first pressure sensor 31 and the pressure P3 of the returning pressurized fluid from the second pressure sensor 32 to select the first operation when P3<P2, and to select the second operation when P3>P2.

When the first operation is selected, the controller 33 switches the recovery valve 23, the pressure accumulation valve 26 and the reproduction valve 30 in the similar manner as set forth above, and in conjunction therewith, the set pressure of the sequence valve 28 is set at low pressure. When the second operation is selected, the controller 33 switches the recovery valve 23, the pressure accumulation valve 26 and the reproduction valve 30 in the similar manner as set forth above, and in conjunction therewith, the set pressure of the sequence valve 28 is set at high pressure.

What is claimed is:

1. A pressurized fluid recovery/reutilization system comprising a primary hydraulic pump supplying a pressurized fluid returned from an actuator, a first circuit supplying the returning pressurized fluid from the actuator, a first pump motor connected to said first circuit, a variable displacement type second pump motor mechanically coupled with said first pump motor and connected to a second circuit, a third circuit communicating said first circuit and a discharge passage of said primary hydraulic pump, a pressure accumulator provided in said second circuit, and a reproduction valve switching said third circuit between a state permitting the flow of a pressurized fluid and a state blocking the flow.

2. The pressurized fluid recovery/reutilization system as defined by claim 1, wherein a pressure accumulation valve is provided for establishing and blocking communication of said second circuit, and a sequence valve is provided between said second circuit on the side of said second pump motor of said pressure accumulation valve and the discharge passage of the primary hydraulic pump.

3. A pressurized fluid recovery/reutilization system comprising a primary hydraulic pump supplying a pressurized fluid returned from a plurality of actuators, a first circuit supplied the returning pressurized fluid from the actuators, a recovery valve for switching said first circuit between a first state permitting flow of the pressurized fluid and a second state blocking the flow, a plurality of solenoid valves provided between said actuators and said recovery valve, respectively and each being placed at a first position to supply the returning pressurized fluid to said recovery valve or a second position to drain the returning pressurized fluid to a tank, a pressure converter having a first pump motor connected to said first circuit, a variable displacement type second pump motor mechanically coupled with said first pump motor and connected to a second circuit, a third circuit communicating said first circuit and a discharge passage of said primary hydraulic pump, a pressure accumulator provided in said second circuit, a reproduction valve switching said third circuit between a state permitting the flow of a pressurized fluid and a state blocking the flow, a pressure accumulation valve provided for establishing and blocking communication of said second circuit, and a sequence valve provided between said second circuit on the side of said second pump motor of said pressure accumulation valve and the discharge passage of the primary hydraulic pump.

4. The pressurized fluid recovery/reutilization system as defined by claim 3, further comprising first means for detecting a discharge pressure of said primary hydraulic pump, second means for detecting an accumulated pressure of said pressure accumulator of said second circuit, and third means for switching said recovery valve, said pressure accumulation valve and said reproduction valve on the basis of detected pressures of said first and second means, and in conjunction therewith to vary the set pressure of said sequence valve, said third means has a function for placing said recovery valve at said second state, said pressure accumulation valve at communicating condition and said reproduction valve at said first condition and in conjunction therewith setting the set pressure of said sequence valve at high pressure when a differential pressure of said accumulated pressure and the discharge pressure is higher than or equal to a set differential pressure, and placing said recovery valve and said reproduction valve at said second state and said pressure accumulation valve at the communicating condition and in conjunction therewith setting the set pressure of said sequence valve at low pressure when the differential pressure of said accumulated pressure and the discharge pressure is lower than or equal to said set differential pressure.

5. The pressurized fluid recovery/reutilization system as defined by claim 3, further comprising first means for detecting a discharge pressure of said primary hydraulic pump, second means for detecting a returning pressurized fluid of said first circuit, and third means for switching said recovery valve, said pressure accumulation valve and said reproduction valve on the basis of detected pressures of said first and second means, and in conjunction therewith to vary the set pressure of said sequence valve, said third means has a function for placing said recovery valve at said first state, said pressure accumulation valve at blocking condition and said reproduction valve at said second condition and in conjunction therewith setting the set pressure of said sequence valve at low pressure when said pressure is lower than said discharge pressure, and placing said recovery valve and said reproduction valve at said first state and said pressure accumulation valve at the blocking condition and in conjunction therewith setting the set pressure of said sequence valve at high pressure when said pressure is higher than said discharge pressure.

* * * * *